US008192246B2

(12) United States Patent
Ostendorff et al.

(10) Patent No.: US 8,192,246 B2
(45) Date of Patent: Jun. 5, 2012

(54) TOY VEHICLE TRACK SET

(75) Inventors: Eric C. Ostendorff, Torrance, CA (US); Michael Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 12/869,706

(22) Filed: Aug. 26, 2010

(65) Prior Publication Data

US 2011/0053456 A1 Mar. 3, 2011

Related U.S. Application Data

(63) Continuation-in-part of application No. 11/855,680, filed on Sep. 14, 2007, now Pat. No. 7,963,821.

(51) Int. Cl.
*A63H 18/14* (2006.01)

(52) U.S. Cl. ..... 446/444; 446/429

(58) Field of Classification Search ..... 446/444, 446/429

See application file for complete search history.

(56) References Cited

U.S. PATENT DOCUMENTS

| | | | |
|---|---|---|---|
| 798,102 | A | 8/1905 | Honneus |
| 798,966 | A | 9/1905 | Johnson |
| 812,595 | A | 2/1906 | Roberts |
| 1,527,006 | A | 2/1925 | O'Reilly |
| 1,599,982 | A | 9/1926 | Bauer |
| 2,999,689 | A | 9/1961 | Litwinczuk |
| 3,590,524 | A | 7/1971 | Beny et al. |
| 3,621,602 | A | 11/1971 | Barcus et al. |
| 3,636,651 | A | 1/1972 | Lohr et al. |
| 3,641,704 | A | 2/1972 | Sims et al. |
| 3,677,469 | A | 7/1972 | Edmisson et al. |
| 3,683,514 | A | 8/1972 | Hughes |
| 3,726,476 | A | 4/1973 | Porter et al. |

(Continued)

FOREIGN PATENT DOCUMENTS

| | | | |
|---|---|---|---|
| GB | 2103949 | A | 3/1983 |

(Continued)

OTHER PUBLICATIONS

International Search Report dated Apr. 9, 2009 for International Application No. PCT/US2008/076209, International Filing Date Sep. 12, 2008.

(Continued)

*Primary Examiner* — Gene Kim
*Assistant Examiner* — Michael Dennis
(74) *Attorney, Agent, or Firm* — Cantor Colburn LLP

(57) ABSTRACT

A stunt arrangement for a toy vehicle including a launching section configured to launch a propelled toy vehicle into flight; a capturing section configured to receive the toy vehicle from the flight; a deflection section disposed between the launching section and the capturing section and configured to be impacted by the toy vehicle in flight and to redirect the vehicle toward the capturing section, wherein the deflection section includes a target, the target being pivotally secured to a release mechanism for movement from a first position to a second position, wherein movement of the target from the first position to the second position causes the release mechanism to drop another toy vehicle towards the capturing section; and a reorienting section coupled to an outlet of the capturing section, the reorienting section being rotatably driven about the desired direction of travel and is configured to upright the toy vehicle or the another toy vehicle if either vehicle exits the capturing section partly or completely inverted.

20 Claims, 14 Drawing Sheets

U.S. PATENT DOCUMENTS

| | | | | |
|---|---|---|---|---|
| 3,762,095 | A | 10/1973 | Merino et al. | |
| 3,814,021 | A | 6/1974 | McHenry | |
| 3,860,238 | A | 1/1975 | Kojima | |
| 4,174,587 | A | 11/1979 | Morin et al. | |
| 4,383,688 | A | 5/1983 | Prehodka | |
| 4,394,961 | A | 7/1983 | Muller | |
| 4,516,953 | A | 5/1985 | Hippely et al. | |
| 4,519,789 | A | 5/1985 | Halford et al. | |
| 4,558,867 | A | 12/1985 | Hippely | |
| 4,575,350 | A | 3/1986 | Hippely et al. | |
| 5,038,685 | A | 8/1991 | Yoneda et al. | |
| 5,102,133 | A | 4/1992 | Chilton et al. | |
| 5,234,216 | A | 8/1993 | Ostendorff | |
| 5,452,893 | A | 9/1995 | Faulk et al. | |
| 5,873,521 | A | 2/1999 | Ernst | |
| 5,899,789 | A | 5/1999 | Rehkemper et al. | |
| 6,089,951 | A | 7/2000 | Ostendorff | |
| 6,170,754 | B1 | 1/2001 | Halford | |
| 6,216,600 | B1 | 4/2001 | Verret | |
| 6,241,573 | B1 | 6/2001 | Ostendorff et al. | |
| 6,676,480 | B2 * | 1/2004 | Sheltman | 446/429 |
| 6,695,675 | B1 | 2/2004 | Ngan | |
| 6,793,554 | B1 | 9/2004 | Newbold | |
| 6,913,508 | B2 * | 7/2005 | Hornsby et al. | 446/438 |
| 6,951,497 | B1 | 10/2005 | Ngan | |
| 2003/0224697 | A1 | 12/2003 | Sheltman et al. | |
| 2005/0076617 | A1 | 4/2005 | Hellmann et al. | |
| 2005/0148281 | A1 | 7/2005 | Sanchez-Castro et al. | |
| 2005/0191938 | A1 | 9/2005 | Sheltman et al. | |
| 2005/0191939 | A1 | 9/2005 | Sheltman et al. | |
| 2005/0287914 | A1 | 12/2005 | Sheltman et al. | |
| 2005/0287915 | A1 | 12/2005 | Sheltman et al. | |
| 2005/0287916 | A1 | 12/2005 | Sheltman et al. | |
| 2005/0287917 | A1 | 12/2005 | Sheltman et al. | |
| 2005/0287918 | A1 | 12/2005 | Sheltman et al. | |
| 2005/0287919 | A1 | 12/2005 | Sheltman et al. | |
| 2007/0049160 | A1 | 3/2007 | Matthes et al. | |

FOREIGN PATENT DOCUMENTS

| | | | |
|---|---|---|---|
| GB | 2200297 | A | 8/1988 |
| JP | 03047286 | A | 2/1991 |
| JP | 2001246176 | A | 9/2001 |
| WO | 9201497 | A1 | 2/1992 |
| WO | 9949948 | A1 | 10/1999 |

OTHER PUBLICATIONS

Written Opinion dated Apr. 9, 2009 for International Application No. PCT/US2008/076209, International Filing Date Sep. 12, 2008.

* cited by examiner

TOY VEHICLE TRACK SET

CROSS REFERENCE TO RELATED APPLICATIONS

This application is a continuation-in-part of U.S. patent application Ser. No. 11/855,680, filed Sep. 14, 2007, the contents of which are incorporated herein by reference thereto.

BACKGROUND

Play sets for toy vehicles are popular toys which are known to provide entertainment and excitement to a user. These play sets typically include a track configuration intended to guide a propelled toy vehicle, such as a 1/64 scale die-cast metal toy vehicle, through a course. The track configurations include closed-loop continuous track arrangements and open-end arrangements. Toy vehicles are placed on these play set tracks and propelled across the configuration by hand or by an external propulsion means.

To bring increased entertainment and excitement to play sets, track configurations may include features such as intersecting tracks, loop segments, and other types of track configurations known in the art. Additionally, attempts have been made at incorporating jumps into these race sets by which a traveling toy vehicle is briefly separated from the track to ultimately rejoin the track at a downstream location. However, these attempts have been limited due to the complexities of ensuring that the launched toy vehicle lands on the downstream track segment in a proper orientation to thus allow the vehicle to continue its course of travel. For example, a launched toy vehicle which re-enters the track inverted or misaligned relative to a longitudinal axis of the track would prohibit wheeled forward progress and thus interrupt play.

Accordingly, a play set for toy vehicles is desired which can provide the entertainment and excitement of a toy vehicle launched from a track and which also includes provisions for returning the launched vehicle to the track in a proper orientation to allow continuous play despite any misalignment which may occur during flight.

BRIEF SUMMARY OF INVENTION

In one embodiment, a stunt arrangement for a toy vehicle is provided. The stunt arrangement including a launching section configured to launch a propelled toy vehicle into flight; a capturing section configured to receive the toy vehicle from the flight; a deflection section disposed between the launching section and the capturing section and configured to be impacted by the toy vehicle in flight and to redirect the vehicle toward the capturing section, wherein the deflection section includes a target, the target being pivotally secured to a release mechanism for movement from a first position to a second position, wherein movement of the target from the first position to the second position causes the release mechanism to drop another toy vehicle towards the capturing section; and a reorienting section coupled to an outlet of the capturing section, the reorienting section being rotatably driven about the desired direction of travel and is configured to upright the toy vehicle or the another toy vehicle if either vehicle exits the capturing section partly or completely inverted.

In another embodiment, a toy track set is provided, the toy set having: a path for a toy vehicle to travel along, a first portion of the path being defined by a track connecting a launching portion with a capturing portion and a second portion of the path being defined by an air gap located between the launching portion and the capturing portion; a release mechanism positioned in the air gap, the release mechanism having a target, the target being pivotally secured to a release mechanism for movement from a first position to a second position, wherein movement of the target from the first position to the second position causes the release mechanism to drop another toy vehicle towards the capturing portion; wherein the launching portion is configured to launch the toy vehicle into the air gap; wherein the capturing portion is configured to capture the toy vehicle or the another toy vehicle from the air gap; and wherein the capturing portion further comprises a rotating tube that receives the toy vehicle or the another toy vehicle therein and directs the toy vehicle to the first portion of the path.

In another embodiment, a method of moving a plurality of toy vehicles along a toy vehicle track path is provided. The method including the steps of: storing at least one toy vehicle in a release mechanism; moving at least one other toy vehicle along a path, a first portion of the path being defined by a track connecting a launching portion with a capturing portion and a second portion of the path being defined by an air gap located between the launching portion and the capturing portion, wherein the release mechanism is positioned in the air gap; releasing the at least one toy vehicle from the release mechanism when a target pivotally secured to a release mechanism is moved from a first position to a second position by the at least one other toy vehicle traveling in the air gap; wherein movement of the target from the first position to the second position causes the release mechanism to drop the at least one toy vehicle towards the capturing portion; wherein the launching portion is configured to launch the at least one other toy vehicle into the air gap; and wherein the capturing portion is configured to capture the at least one toy vehicle or the at least one other toy vehicle from the air gap.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1A:
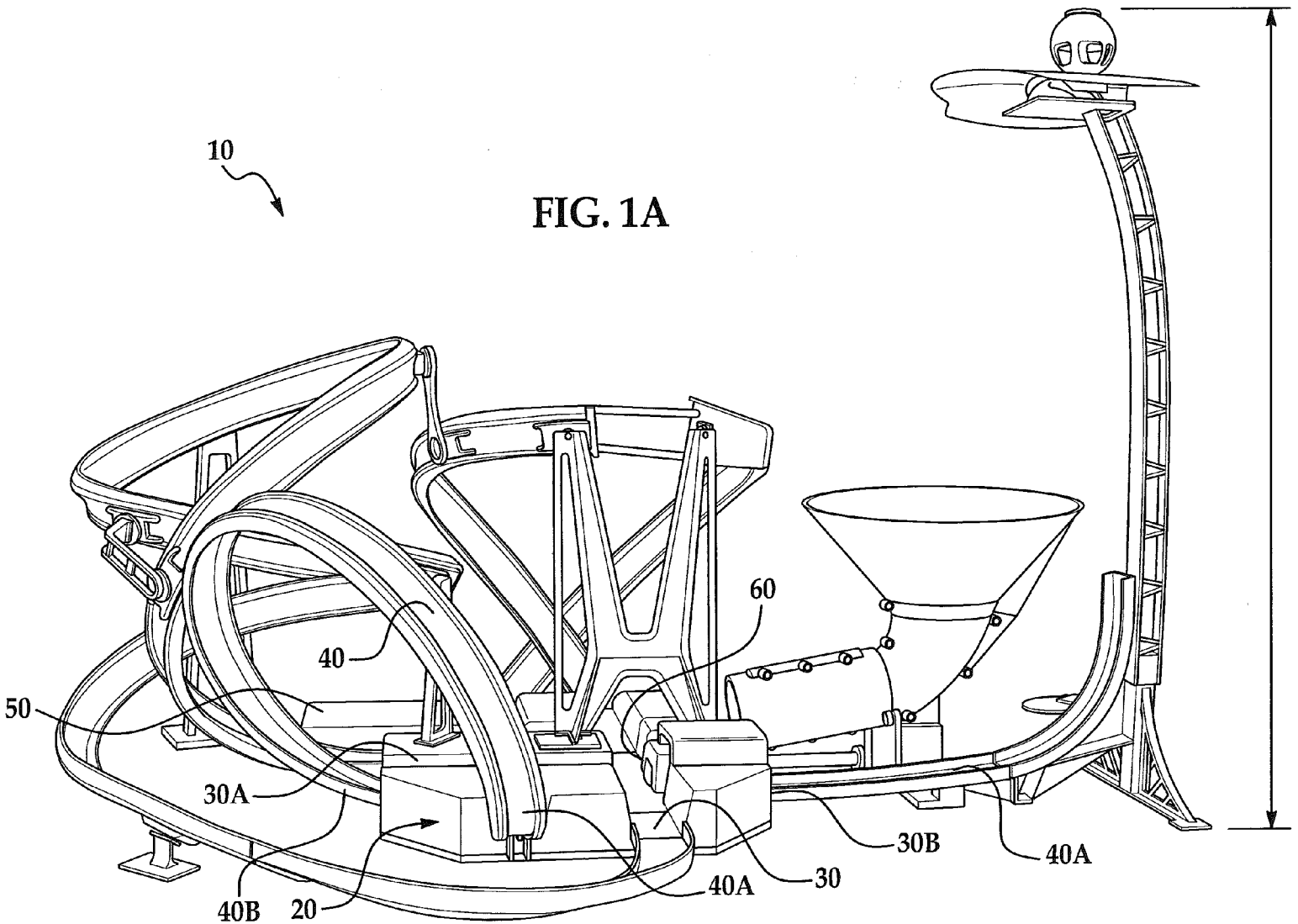
FIG. 1A illustrates a perspective view of a play set according to an embodiment of the invention.
Figure 1B:
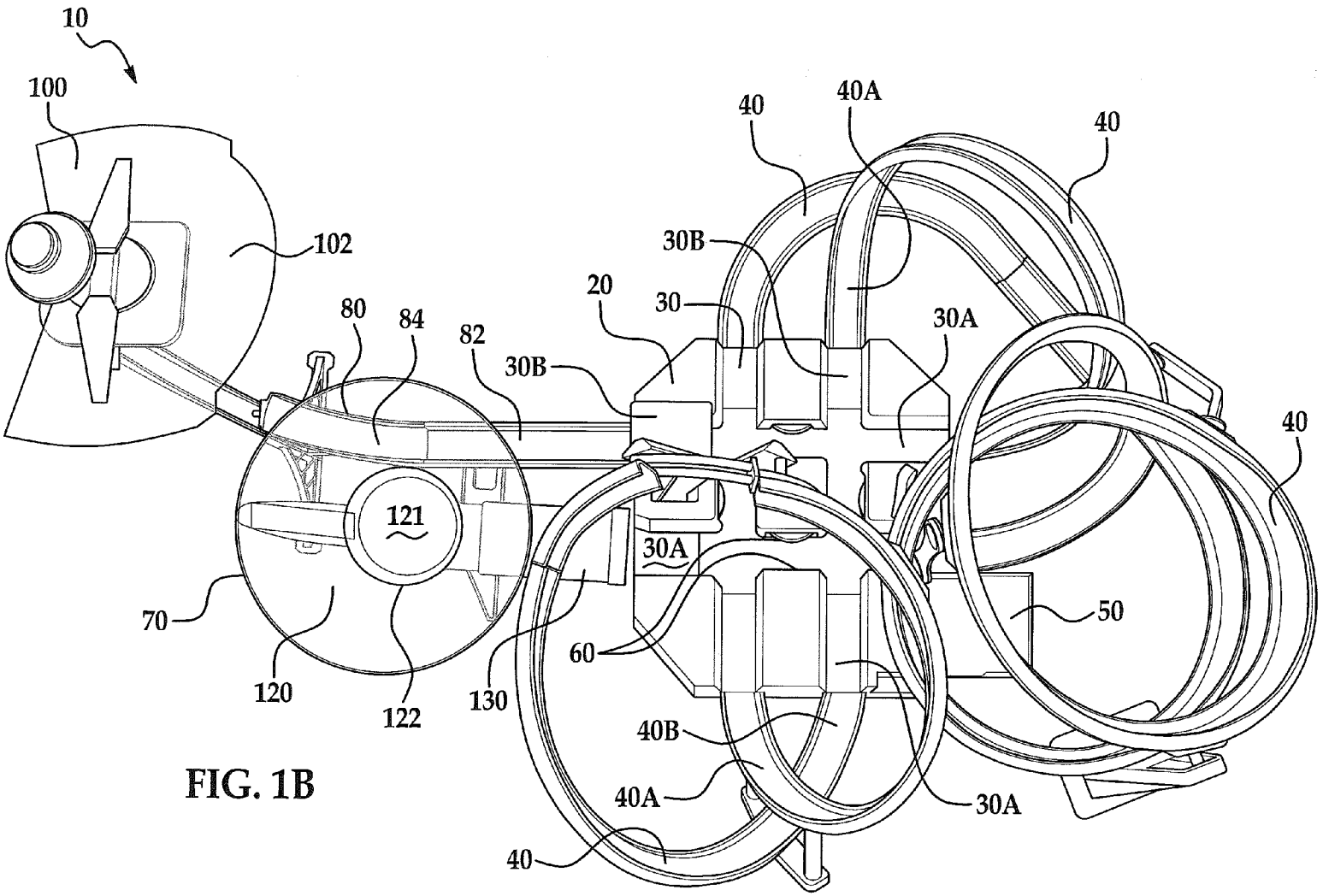
FIG. 1B illustrates a plan view thereof.

FIG. 1A shows an exemplary play set 10 for toy vehicles in one embodiment according to the present invention. The play set 10 includes a base 20 having four propelling tracks 30 defined therein and a plurality of external tracks 40 extending from and then ultimately returning to the base 20. Each propelling track 30 includes an inlet 30A and an outlet 30B for allowing, respectively, ingress and egress of a toy vehicle. Correspondingly, each external track 40 includes an inlet 40A and an outlet 40B. The inlets 40A of the external tracks are fitted to the outlets 30B of the propelling tracks. Similarly, the outlets 40B of the external tracks are fitted to the inlets 30A of the propelling tracks. This arrangement allows for continuous movement of the toy vehicle throughout the play set 10. In this exemplary embodiment, the base includes four intersecting propulsion tracks 30 and four corresponding external tracks 40. The external tracks 40 include stunt features described in more detail below.

The propelling tracks 30 and the external tracks 40 are each designed for use with toy vehicles that ride on wheels disposed in contact with the propelling tracks 30 and the external tracks 40. The base 20 further includes a propulsion unit configured to accelerate the toy vehicles through the propulsion tracks 30, sending the vehicles at relatively high speeds into the external tracks 40. In this example, the propulsion unit is powered by a motor 50 that is coupled to one or more booster wheels 60 that are each arranged in the propelling tracks 30. The booster wheels 60 may be made of rubber (PVC), foam, or other materials known in the art. Each propelling track 30 may include a single wheel 60 or two oppositely disposed wheels 60. The motor 50, which may be a 6-volt electric motor, rotates the booster wheels 60 at high speeds such that vehicles travel along the propelling tracks 30 contact the rotating wheels 60 and are propelled forward thereby at high speeds that insure the return of the vehicles to the base 20 after each track 40 is traversed. As such, vehicles traveling through the play set 10 may traverse long series of loops and other stunt features of multiple external tracks 40 as long as the play set 10 is operated or until the vehicles crash into one another at the intersections of the propulsions tracks 30.

As mentioned, the external tracks 40 may include any combination of stunts arrangements. In the illustrated embodiment, the tracks 40 each include a loop, twist, and/or spiral section or a combination thereof. Of course, other looping and/or twisting arrangements of the external tracks 40 are contemplated.

Figure 2:
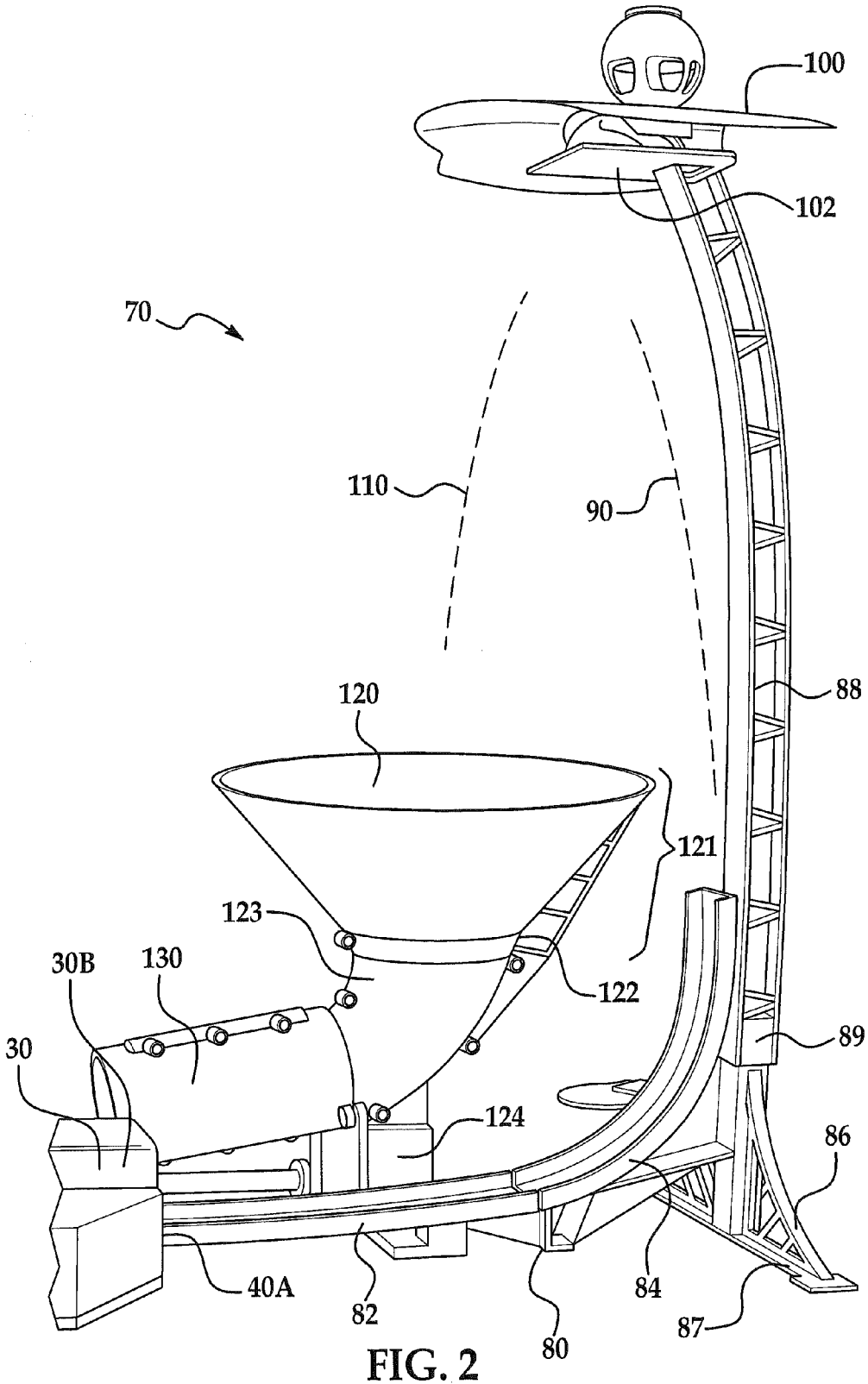
FIG. 2 illustrates a jumping and capturing stunt track arrangement for a play set, according to an embodiment of the invention.

At least one of the external tracks 40 may include a jumping and capturing stunt track arrangement 70, as best seen in FIG. 2. The stunt track arrangement 70 includes a launching section 80, first and second paths of travel 90 and 110, a deflection section 100 disposed generally between the free flight sections, a capturing section 120, and a reorienting section 130.

The launching section 80 is composed of a straight track 82 having an inlet 40A affixed to an outlet 30B of the propulsion track 30. The launching section 80 further includes a quarter circle track portion 84 disposed in continuation of the straight track 82 and opposite from the inlet 40A.

Thus, a vehicle having a sufficient initial velocity as propelled from the outlet 30B of the base 20 will traverse the straight track 82 and the quarter circle track 84 of the launching section 80 and then enter free flight at the termination of the quarter circle portion. Such toy vehicle will then generally travel through the first path of travel 90. Subsequently, the vehicle may impact a shield 102 of the deflection section 100 and fall generally through the second path of travel 110 toward a hopper 122 of the capturing section 120. Alternatively, the vehicle may not impact the shield 102 but instead simply reach an apex of flight and then descend downwardly toward the hopper 122. In one embodiment, a toy vehicle launched from the quarter circle track 84 may travel upward approximately thirty inches before beginning its descent toward the hopper 122. The quarter circle track 84 may be angled slightly in a direction toward the hopper 122 in order to ensure that the flight of the vehicle terminates in the hopper 122. The vehicle then proceeds through the hopper 122 and exits the capturing section 120 into a reorienting cylinder of the reorienting section 130. As will be discussed in further detail herein, the hopper 122 is configured to catch the descending vehicle and to orient the vehicle in a head or tail first position and the reorienting section 130 is configured to upright the vehicle if inverted. The properly oriented and uprighted vehicle then rolls out of the reorienting section 130 and into an inlet 30A of a propulsion track 30. The base 20 may then propel the vehicle elsewhere within the race set 10.

The launching section 80 includes the quarter circle track 84 and a stand 86 for support. The straight track 82 may be substantially flat or may gradually or abruptly slope upward or downward to the quarter circle track 84. The quarter circle track 84 curves upward from the proximate end of the straight track 82 and ends abruptly in a substantially vertical orientation.

The stand 86 supports the quarter circle track 84 such that it remains in a consistent position during the operation of the play set 10. The stand 86 includes a pedestal 87 to be positioned on a support surface such as a table, a floor, etc. A spine 88 extends in a substantially vertical direction from the pedestal 87 and is coupled thereto by a connector 89.

The first path of travel 90 extends from the end of the quarter circle track 84, generally parallel to the spine 88, and terminates approximately at the deflection section 100.

Figure 3:
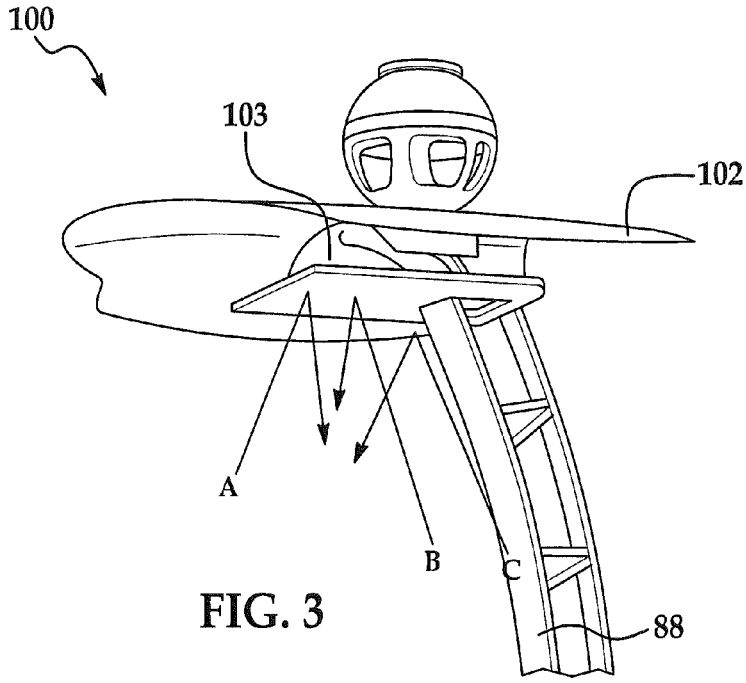
FIG. 3 illustrates a deflection section of the stunt track arrangement of FIG. 2.

As best seen in FIG. 3, the deflection section 100 is disposed at an upper portion of the spine 88 and includes an overhanging member 103 coupled to an upper end of the spine portion 88 and is configured to support the shield 102. As mentioned, the shield 102 is disposed and oriented to be impacted by vehicles in flight. The shield 102 is further configured to redirect the vehicles downward into the hopper 122. According to the illustrated embodiment of the invention, the shield 102 is made of a transparent or semi-transparent material (e.g., clear plastic), and has a generally parabolic shape. The substantially transparent material of the shield 102 allows users to observe vehicles impacting the shield 102 and generally does not obstruct a view of the stunt arrangement 70 from above, nor of the play set 10. In addition, the shield 102 is designed to elastically respond to impacts of the vehicles and to absorb some of the force transferred by these impacts. The generally parabolic shape of the shield 102 encourages incoming vehicles having different initial trajectories, such as trajectories A, B, and C in FIG. 3, to be aimed toward a common target D (e.g., the hopper 122 shown in FIG. 2) upon their respective impacts with the shield 102.

It is noted that the stand 86 which supports the quarter circle track 84 and spine 88 is described herein by way of example only and may include various constructions as long as the constructions are sufficiently stable to remain in position during the operation of the play set 10.

Referring again primarily to FIGS. 2 and 3, in the illustrated embodiment, the spine 88 of the stand 86 includes a curved structure whereby the spine 88 diverges from a vertical axis of the upper portion of the quarter circle track 84 in a direction toward the straight track 82. This curvature extends the horizontal reach of the stand 88 in order to allow the shield 102 to be positioned in an appropriate position above the launching section 80 in order to facilitate impact of the toy vehicles and redirection thereof to the hopper 122. The spine 88 and its curvature also serves to realign a vehicle with the first path of travel 90 if the vehicle is misdirected upon departing from the quarter circle track 84. That is, a misdirected launched toy vehicle may impact a portion of the spine 88 and rebound into one of the exemplary flight paths A, B, and C shown in FIG. 3. Of course, the described curved nature of the spine 88 is merely exemplary. In another embodiment, the spine 88 may include straight structure which extends vertically from the upper portion of the quarter circle track 84. Alternatively, the spine 88 may extend at an angle to the vertical or may include any combination of curved, vertical, and angled sections.

As mentioned, the first path of travel 90 extends generally from the upper portion of the quarter circle track 84 to the shield 102 and the second path of travel 110 extends generally from a lower edge of the shield 102 to an upper edge of the hopper 122 of the capturing section 120. While in free flight in the first and/or second paths of travel 90, 110, vehicles may rotate freely about their longitudinal axis, about an axis perpendicular thereto, or about any axis therebetween. That is, while traversing the paths of travel 90 and 110, a toy vehicle is free to partake in exciting and unpredictable spins, tumbles, flips, etc. Accordingly, the toy vehicle may not reach the capturing section 120 in the proper wheel-down orientation and/or the vehicle may be misaligned relative to the track 40 leading to the base 20. For example, a vehicle may reach the capturing section 120 inverted (wheels-upward) and perpendicular to a direction of travel of the track 40. The capturing section 120 and the reorienting section 130 are configured to correct the orientations of any such misaligned vehicles in order to ensure that the vehicle continues through the stunt arrangement 70 and, if desired, elsewhere within the play set 10.

Figure 4:
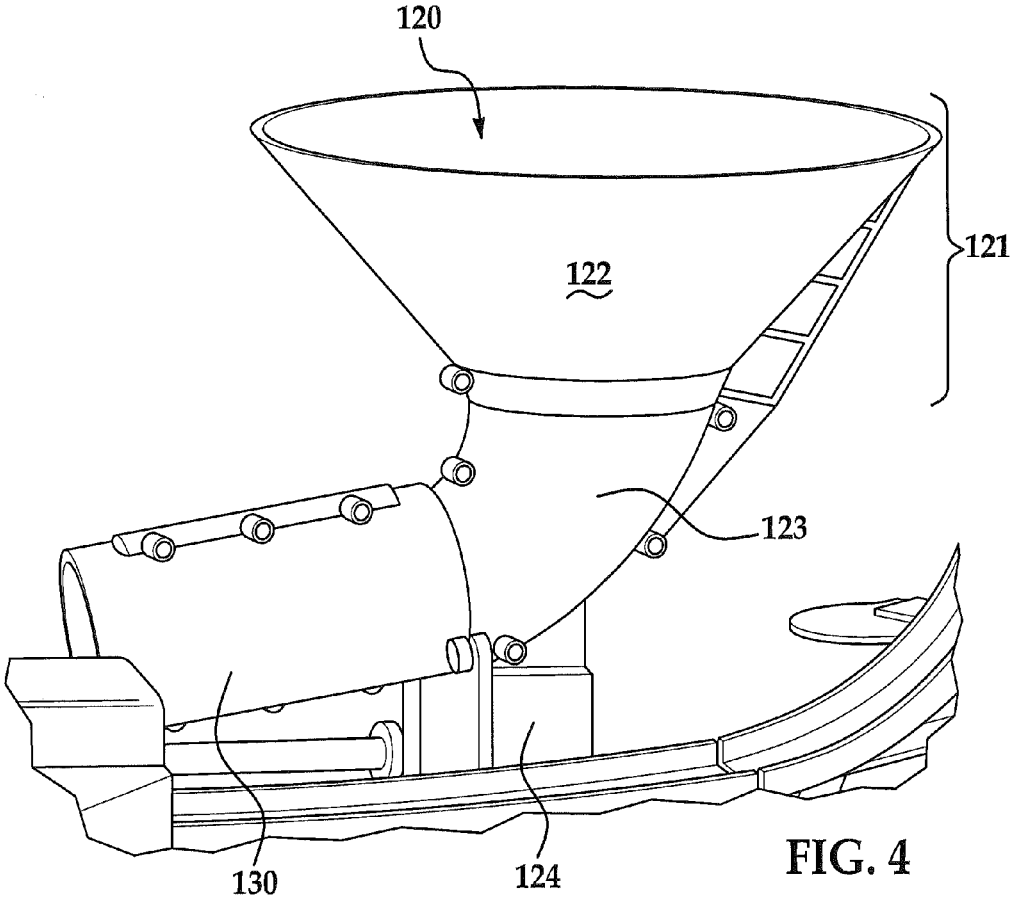
FIG. 4 illustrates a capturing section of the stunt track arrangement of FIG. 3.

As can be seen in FIG. 4 the hopper 122 of the capturing section 120 includes a collector 121, a tail 123 and a supporter 124. The collector 121 is shaped like a large funnel with an open upper end that is significantly larger then any vehicle to be used with the play set 10. From the upper end, the collector 121 tapers downwardly toward an outlet having a diameter which is large enough to allow single vehicles to exit. Here the collector 121 is connected to the tail 123 which essentially includes a tube of circular cross-section which includes a decreasing diameter so as to taper in a direction toward the reorienting section 130. Here, the tail 123 traverses a curve having an arc in the range of 0°-90° and, particularly, about 30°.

Furthermore, the narrowing end of the collector 121 and the tapering and curvature of the tail 123 assist descending vehicles to be positioned either head first or tail first, i.e., frontward or backward, for entry into the reorientation section 130. In this manner, a descending vehicle strikes a portion of the collector 121 where the relatively steep walls of the collector 121 result in the vehicle sliding downward toward the tail 123. The circular cross-sectional shape and the decreasing diameter of both the collector 121 and the tail 123, and the curvature in the tail 123, naturally orient the downwardly sliding toy vehicle into a head or tail first position. That is, the collector 121 and the tail 123 are configured such that the toy vehicle may not pass therethrough when its longitudinal axis is not substantially aligned with the longitudinal axes of the collector 121 and the tail 123. In this way, the vehicle is delivered in the frontward or backward position to the reorienting section 130.

The collector 121 may be made of a similar transparent or semi-transparent material as that of the shield 102 to allow users to observe the vehicles being collected and to insure that any impacts between the vehicles and the collector 121 will be at least partially absorbed to thus minimize the occurrence of vehicles ejecting from the collector 121 upon hard impact.

The supporter 124 is positioned on a support surface that may be level with the surfaces on which the pedestal 87 of the stand 86 and the base 20 are positioned. The supporter 124 may be connected to any part of the collector 121 or the tail 123 and maintains a position of the capturing section 120 during the operation of the play set 10.

Figure 5:
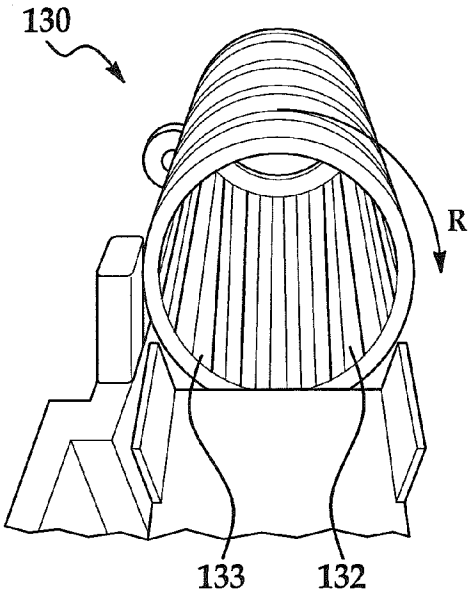
FIG. 5 illustrates a substantially axial view of a reorienting portion of the capturing section of FIG. 4.

As shown in FIGS. 4-5, the reorienting section 130 includes a downwardly angled cylinder which is rotatable at a substantially constant angular speed, R (e.g., at approximately 20-30 RPM), about a longitudinal axis of the cylinder. The reorienting section 130 (sometimes referred to herein as, "the reorienting cylinder 130") may be powered by the motor 50 mentioned previously and/or by a separate power source. An interior of the reorienting cylinder 130 is lined with alternating surfaces 132 and 133. The surfaces 133 are generally smooth and have a relatively lower coefficient of friction with respect to the toy vehicles. The surfaces 132 generally yield a relatively higher coefficient of friction than the smooth interior surfaces 133. The smooth surfaces 133 may simply include the material of which the cylinder 130 is composed, for example, a transparent or semi-transparent plastic material. The surfaces 132 may include strips of a frictional material, such as rubber or plastic, disposed on the interior of the cylinder 130 by adhesive means. Alternatively, the surfaces 132 may result from a liquid application upon the interior of the cylinder 130 or from another physical modification of the cylinder interior. In any event, the surfaces 132 are arranged substantially evenly around an inner surface of the reorienting cylinder 130. The surfaces 132 are aligned generally parallel with each other and in line with the longitudinal axis of the cylinder 130. Thus, as the reorienting cylinder 130 rotates, the surfaces 132 correspondingly rotate about the longitudinal axis of the cylinder.

As discussed, when a toy vehicle enters the reorienting section 130 from the tail 123, the vehicle is generally aligned with the longitudinal axis of the tail 123 and correspondingly with the longitudinal axis of the reorienting section 130. Advantageously, this axis is further in alignment with the direction of travel provided by the propelling track 30 connected to the section 130 opposite from the tail 123. As described, this track section 30 directs a vehicle away from the section 130 and through the base 20. Accordingly, the capturing section 120 delivers a caught vehicle to the reorienting cylinder 130 in axial alignment with the cylinder 130 and with the subsequent propelling track 30.

If a vehicle enters the reorienting section upright with wheels down, the vehicle will simply roll through the reorienting section 130 in accordance with the velocity of the vehicle at the entrance of the cylinder 130. That is, due to the momentum of the vehicle and the downward slope of the cylinder 130, the vehicle will quickly move through the cylinder 130 un-affected by the rotating surfaces 132, 133. However, if the vehicle is partly or completely inverted (e.g., the vehicle is laying on a side or a roof thereof), the vehicle will be prevented from passing through the reorienting tube 130 by the friction between the surfaces 132 and the frame of the vehicle. That is, the friction created between the surface 132 and the vehicle will prevent the vehicle from sliding through the cylinder in the direction of the longitudinal axis thereof. Instead, the vehicle is halted temporarily and the angular momentum of the rotating surfaces 132 will rotate the vehicle about its longitudinal axis to an upright, wheels-down position at which point the vehicle then rolls out of the reorienting section 130 and into the track 30.

Figure 6A:
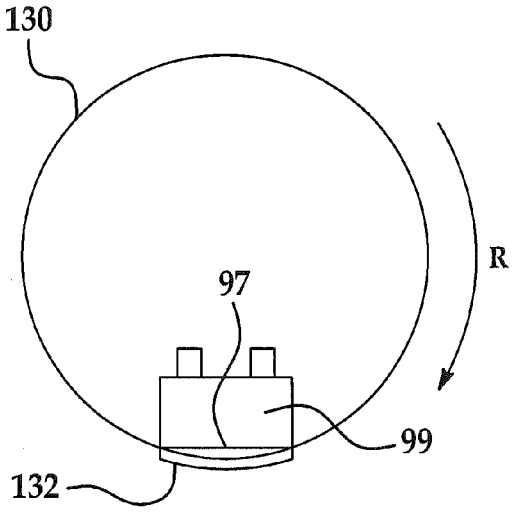
FIGS. 6A-6C illustrates a sequence of operation of the reorienting section of FIG. 5.
Figure 6B:
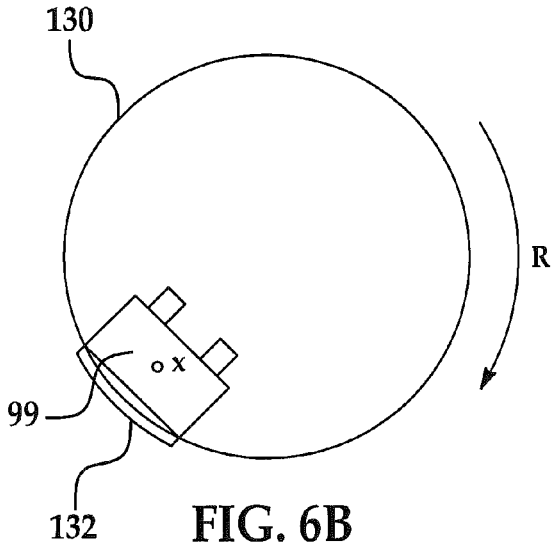
Figure 6C:
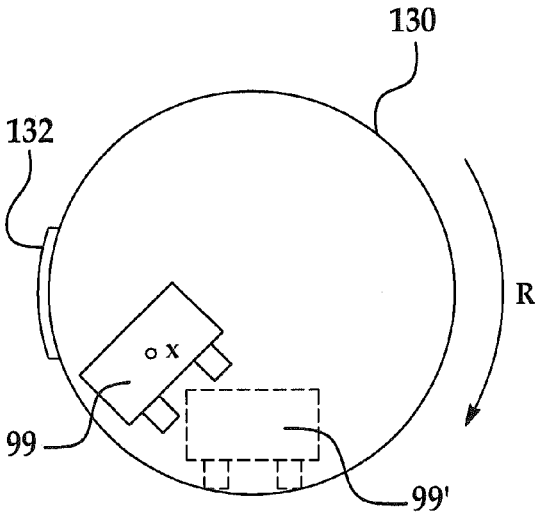
Figure 8:
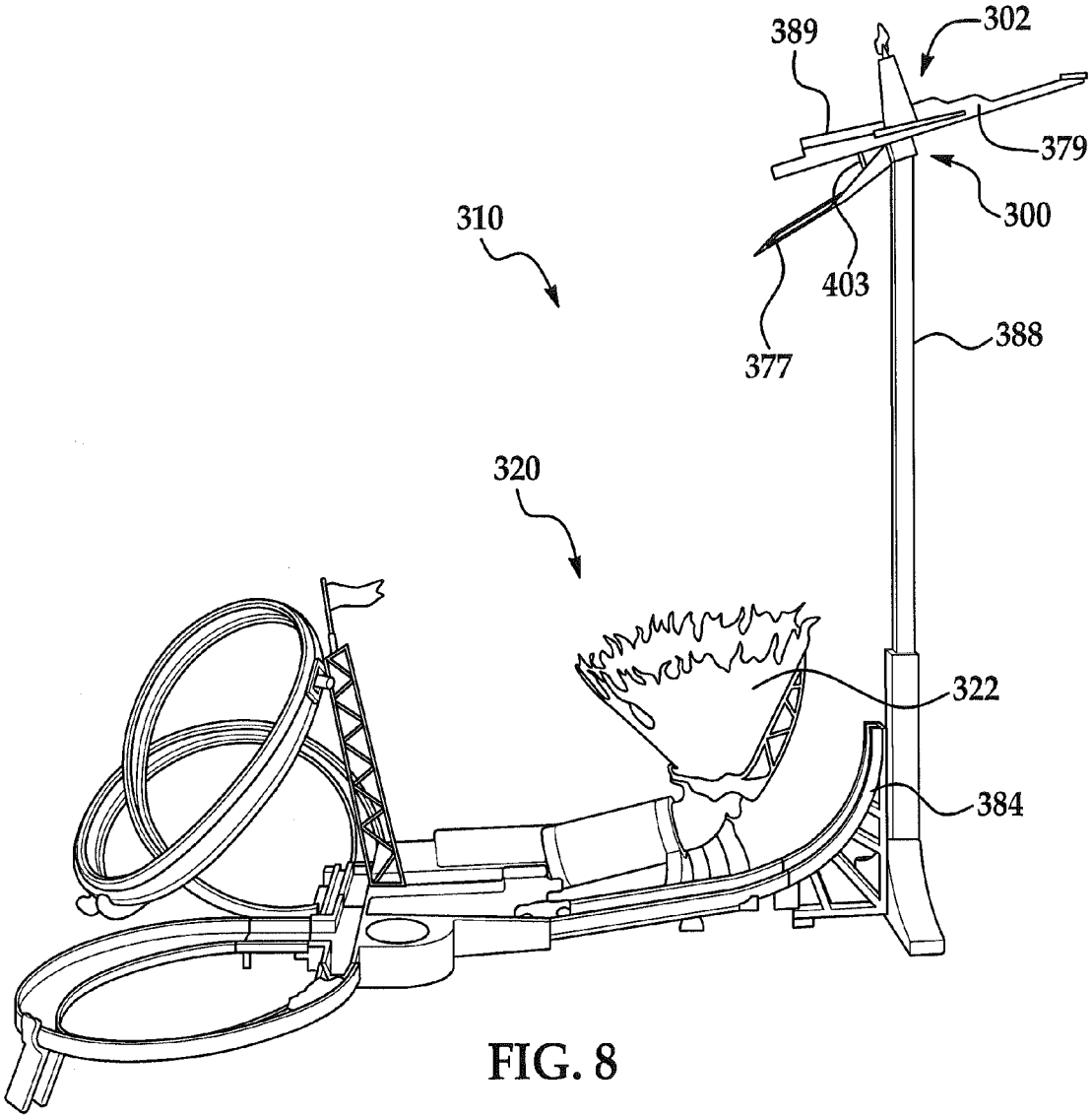
FIG. 8 illustrates an alternative exemplary embodiment of the present invention.
Figure 9:
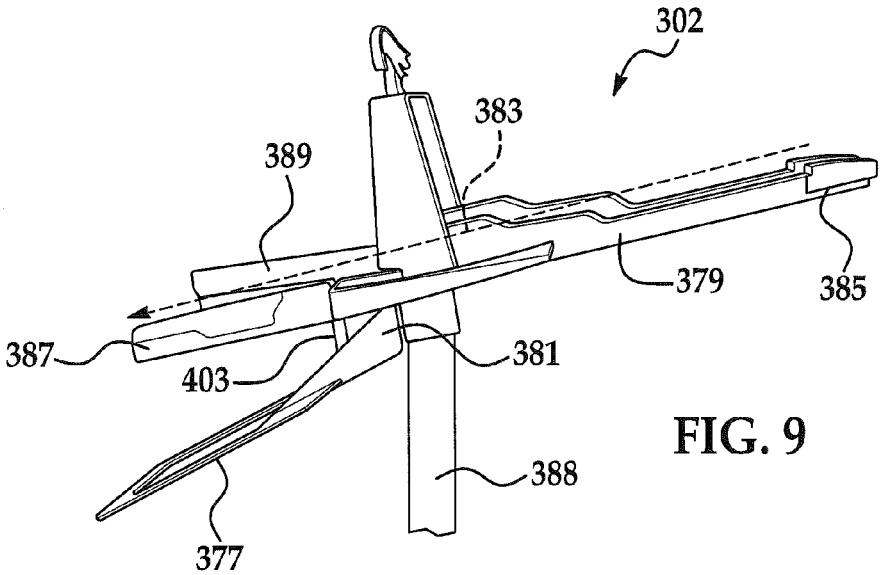
FIG. 9 illustrates a release mechanism of the FIG. 8 embodiment.

FIGS. 6A-6C show cross-sectional views of the cylinder of the reorienting section 130 during a sequence in which an inverted vehicle 99 is reoriented by action of the cylinder 130. The cylinder 130 is rotating about its axis in the direction R. The vehicle 99 is in the inverted position in FIG. 6A. Thus, a roof 97 of the vehicle 99 engages the cylinder 130 and particularly engages one of the surfaces 132 shown here by a heavy line. In FIG. 6B, the rotation of the cylinder 130 and the engagement between the surface 132 and the vehicle 99 causes the vehicle to rotate about the longitudinal axis of the cylinder 130 in the direction indicated by the arrow R. In FIG. 6C, the surface 132 has imparted enough angular momentum upon the vehicle 99 to rotate it about its axis x approximately 180° so that the vehicle assumes an upright orientation 99'. Now, the vehicle 99 is free to roll through and out of the cylinder 130.

According to embodiments of the invention, the launching section 80, the deflection section 100 and the capturing section 120 may be positioned at various positions relative to one another and may be configured to adjust to those various positions. For example, a height of the deflection section 100 relative to the launching section 80, or the angle of the launching section 80, etc., may be automatically or manually adjusted.

Figure 7:
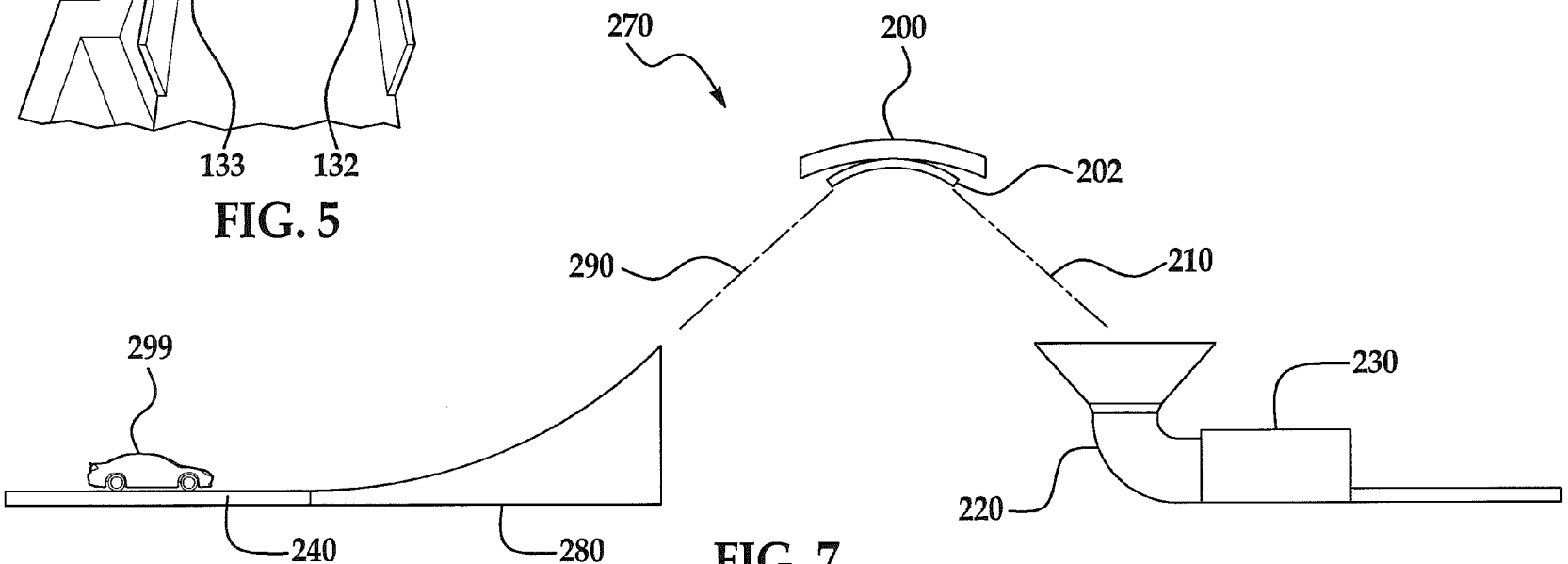
FIG. 7 illustrates a jumping and capturing stunt track arrangement according to another embodiment of the invention.

FIG. 7 shows an alternative embodiment of a stunt arrangement 270 including a launching section 280 directed in a non-vertical direction. For example, the launching section 280 may be angled in a more lateral orientation. As such, a capturing section 220 is positioned a sufficient lateral distance from the launching section 280 in order to capture a toy vehicle 299 in flight. That is, the capturing section 220 is positioned at a termination of a second path of travel 210. A deflection section 200 may be optionally positioned between the first and second paths of travel 290 and 210, as shown in the drawing. A shield 202 of the deflection section 200 may be reshaped or resized in order to receive the impact of the vehicle 299 in flight and to redirect the vehicle toward the capturing section. In any event, as shown, the vehicle 299 is propelled across a track section 240 to the launching section 280 by which the vehicle 299 takes flight and is permitted to tumble, spin, and rotate about any of a plurality of axes. At the end of flight, the vehicle 299 is received by the capturing section 220, is positioned in a head or tail first alignment as discussed, and delivered to the reorienting section 230 which uprights the vehicle 299, if necessary, generally in the manner described above.

The launching angle of the launching section 80 may be configured as desired, in a range from vertical)(90° to nearly horizontal)(0°) and even over vertical (90°-180°). The deflection section 100 and the recapturing section 130 would simply be positioned and oriented in accordance with the desired launch angle. Still further, the capturing and reorienting sections 120 and 130 may be utilized without the launching section 80 to orient a toy vehicle traveling along a surface. For example, a stunt arrangement in another embodiment of the invention includes a generally planar track surface upon which a toy vehicle is permitted to tumble, slide, spin, etc. in a direction toward the capturing section 120. Here, the capturing section 120 is a large funneling arrangement disposed at one end of the track surface which gathers the careening, rotating vehicle and, in accordance with description above, orients the vehicle in a head or tail first position and delivers the vehicle to the reorienting section 130 which uprights the vehicle if necessary. The capturing and reorienting sections 120 and 130 may be shaped as shown in FIG. 4 in which case the vehicle would descend into the hopper 122 for orientation. Alternatively, the capturing and reorienting sections 120 and 130 may share a common longitudinal axis, i.e., the capturing section 120 and the tail 123 shares the same straight longitudinal axis as the cylinder 130.

The stunt track arrangement 70 is described in association with the play set 10 by way of example only. The stunt arrangement may be employed in the described continuous play set 10 or as a component in other continuous play sets. The stunt arrangement 70 may be utilized as a portion of an open end play set track configuration where toy vehicles are propelled from a start point to an end point between which the vehicles encounter the stunt arrangement 70 and perhaps other stunt arrangements and/or track configurations. Still further, the stunt arrangement may further be utilized independently as a stand alone play set.

The stunt track arrangement 70 and the play set 10 are described herein as being used in conjunction with the electronically driven booster base 20 which automatically propels toy vehicles therefrom by means of rotating booster wheels. In another embodiment, toy vehicles may be propelled to the arrangement 70 and/or to the play set 10 by a manually operated booster arrangement, such as a pneumatic booster activated by a trigger or pump, or by an impact booster activated by application of a downward force, etc.

As mentioned, the described stunt arrangement 70 and play set 10 may be configured for toy vehicles. Of course the arrangement 70 and set 10 may be configured for any moving toy such as rolling or sliding figurines, rolling balls, etc. Furthermore, the play set 10 and particularly the stunt arrangement 70 may be configured for electronically driven slot vehicles. That is, the track segments 40 and launching segment 80 may include slotting to receive such vehicles and further include conductors as is known in the art for powering such vehicles. The slot vehicles would thus be separated from the track at the launching section 80, allowed to freely rotate in flight, and then captured and reoriented in the sections 120 and 130 as described above. The slot vehicle would then be deposited back onto a slotted track and mated with a slot in a proper orientation for onward travel.

The stunt arrangement 70 may further include magnetic elements to influence the flight of a launched vehicle. For example, such magnetic elements may be disposed at areas on the quarter circle track segment 84. Additionally and/or alternatively, the vehicles 99 used in conjunction with the arrangement 70 may include magnetic elements disposed to influence the flight thereof when launched.

Accordingly, a play set and stunt arrangement is described which provides the entertainment and excitement of a toy vehicle launched from a track and which also includes provisions for returning the launched vehicle to the track in a proper orientation to allow continuous play despite any misalignment of the vehicle which may occur during flight.

Referring now to FIGS. 8-15C an alternative exemplary embodiment of the present invention is illustrated. Here components performing similar or analogous functions to other embodiments are labeled in multiples of 100. In this embodiment, a deflection section 300 is provided with a mechanism 302 that is configured to drop additional objects or toy vehicles 399 towards or into a hopper 322 of a capturing section 320 of the play set 310.

Mechanism 302 is located at the top of a spine or stand 388 such that a target 377 or the mechanism is located in a position to be hit by vehicles or object launched from the end of track 384. Mechanism has a base portion 379 that is secured to the spine or stand 388. The target is pivotally secured to base portion 379 for movement between a first position FIGS. 8, 9 and 10-13A and a second position FIG. 13C. In one non-limiting exemplary embodiment target 377 is pivotally mounted to the base portion at a first pivot point 381. The base portion 379 defines a path of travel 383 comprising an inlet end 385 and an outlet end 387. The path of travel, the inlet end and the outlet end are configured to guide objects or toy vehicles from the release mechanism.

Figure 13A:
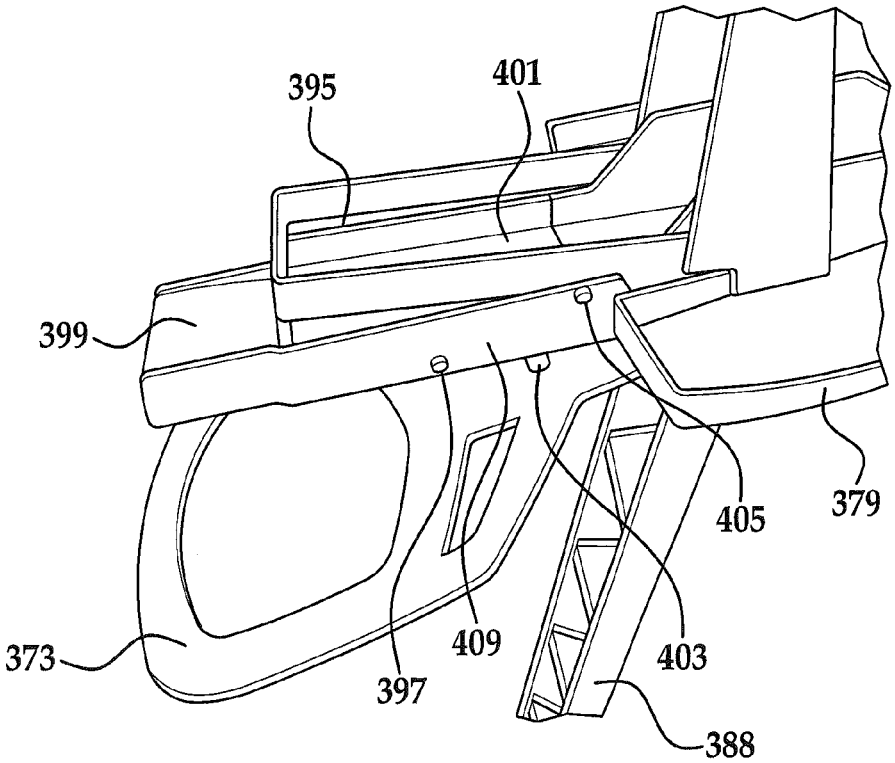
FIGS. 13A-13C and 14A-14B illustrate movement of the release mechanism of an exemplary embodiment of the present invention.
Figure 13B:
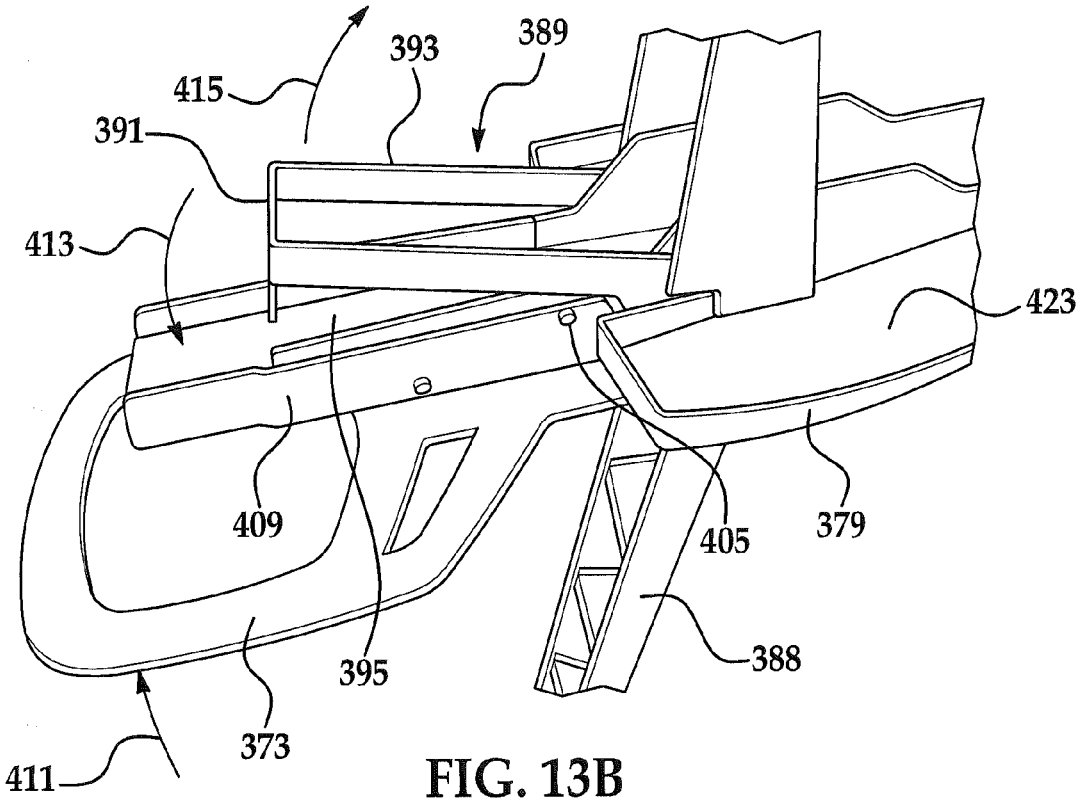
Figure 13C:
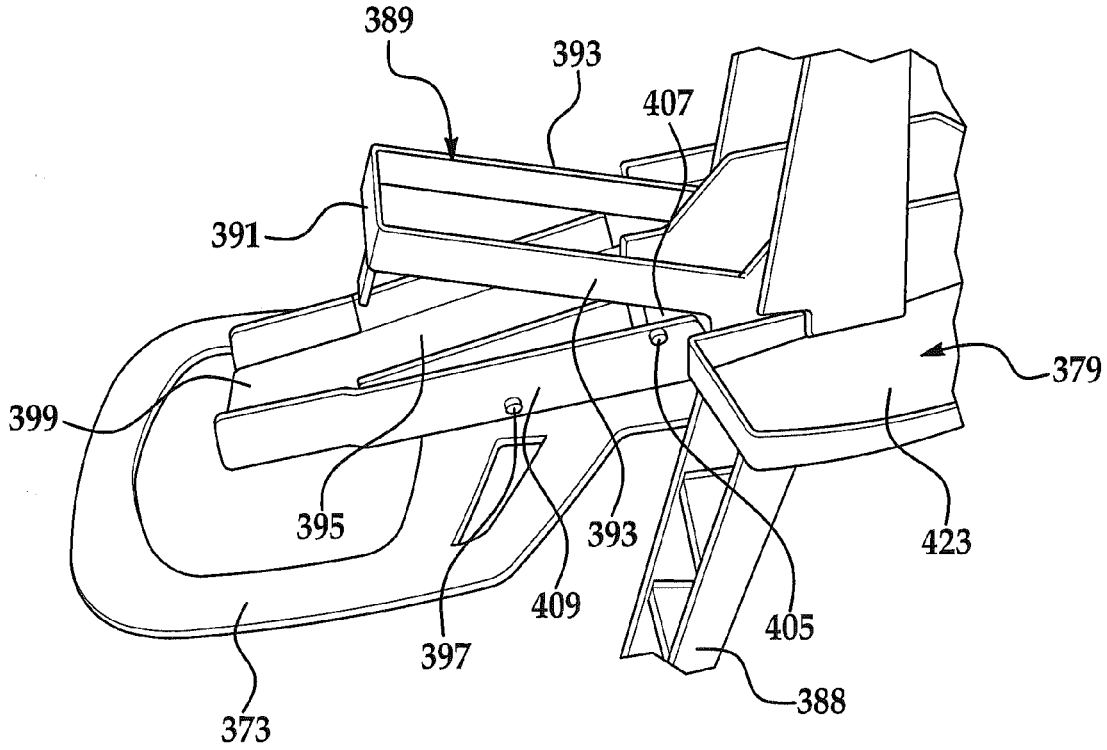

The base portion also has a gate 389 pivotally secured to the base portion for movement between a blocking position FIGS. 8, 9 and 10-13A and an unblocking position FIG. 13C. In one embodiment, the gate is also pivotally mounted to the base portion at the first pivot point. When the gate is in the blocking position a portion 391 of the gate is located in the path of travel 383 such that a vehicle will not advance to the outlet end 387 unless the gate and its associated portion 391 are moved to the unblocking position. In one non-limiting exemplary embodiment, portion 391 of gate 389 is secured to a pair of arm members 393 each of which is pivotally secured to the base portion. The base portion also has a moveable platform 395. The moveable platform 395 is movably secured to the base portion proximate to the outlet end and is configured for movement between a release position (FIG. 13C) and a load position (FIGS. 8, 9 and 10-13A). In one embodiment, the platform is mounted in the outlet end of the base portion and is pivotally secured thereto about a second pivot point 397. The second pivot point being in a different location than the first pivot point. When the platform is in the release position a forward end 399 of the platform is moved downward while a rearward end 401 is moved upward. Conversely and when the platform is in the loading position the forward end 399 of the platform is moved upward and the rearward end 401 is moved downward. The platform further comprises a push rod 403 that extends from a bottom surface of the platform and away from the base portion. The platform also has a pair of features or pins 405 each of which are configured to engage a respective arm member 393 of the gate 389.

Thus and as the rearward end of the platform moves upward the pins 405 engage the gate and move it from the blocking position to the unblocking position. Conversely and as the rearward end of the platform moves downward the pins are received in complementary slots 407 in wall portions 409 of the outlet end of the base portion. The downward movement of the rearward end of the platform allows the gate to move back into the blocking position.

Movement of the platform from the load position to the release position is caused by movement of the target from the first position to the second position. Accordingly and as the target moves from the first position to the second position in the direction of arrow 411 push rod 403 is moved up. This in turn causes the platform to be moved from the load position to the release position in the direction of arrow 413 and simultaneously the gate is moved from the blocking position to the unblocking position in the direction of arrow 415. Accordingly, a toy vehicle or object situated on the platform will be released therefrom when the target is moved from the first position to the second position.

In addition and as illustrated in at least FIG. 13C the rearward end of the platform extends above the path of travel 383 such that another toy vehicle or object cannot be received on the platform until the rearward end has moved downward which will also cause the gate to be in a blocking position such that the object or toy vehicle will roll onto the platform but will be retained on there by the portion 391. This will provide an indexing feature such that each time the target is moved from the first position to the second position a toy vehicle or object positioned on the platform will be released from mechanism 302 and as the target moves back to the first position from the second position the rear end of the platform will be lowered such that a subsequent toy vehicle or object can roll onto the platform and thus be the next vehicle that will be released from the mechanism when the target is moved from the first position to the second position.

The release and loading of vehicles is achieved by gravity since the base portion is angled downwardly towards the outlet end of the base portion such that each vehicle or object roles from the inlet end to the outlet end by gravity forces. In one embodiment and in order to add variations to operation of the release mechanism target 377 is configured to have an opening 417 defined by a perimeter portion 419 of the target such that a toy vehicle launched from track section 384 may or may not hit the target and cause it to move from the first position to the second position. Accordingly, variations in the trajectory of the vehicle being launched from track section 384 may cause the toy vehicle to miss the target entirely and pass through opening 417. If this occurs, the toy vehicle may hit a bottom surface 421 of the base portion proximate to the outlet end 387 and thus be deflected back into hopper 322 similar to the previous embodiments. If on the other hand, the vehicle being launched from track section 384 hits the target and moves it from the first position to the second position a vehicle is released from the release mechanism 302 and the release mechanism and the vehicle launched from track section 384 (e.g., deflected back by contact with the target) are dropped back towards the capturing section. Accordingly, two vehicles are now dropped into the track set and thus two vehicles can be launched from track segment 384. This adds additional play features since multiple vehicles are now travelling along the track and these vehicles can each subsequently release another vehicle from the release mechanism by contacting the target. Therefore, many vehicles may be dropped into the track set until the set is ultimately saturated with too many vehicles travelling thereon or the release mechanism runs out of vehicles. However, a user can feed additional vehicles in at the inlet end of the base portion. In another alternative embodiment, target 377 may be configured to have a solid surface without an opening 417.

Figure 10:
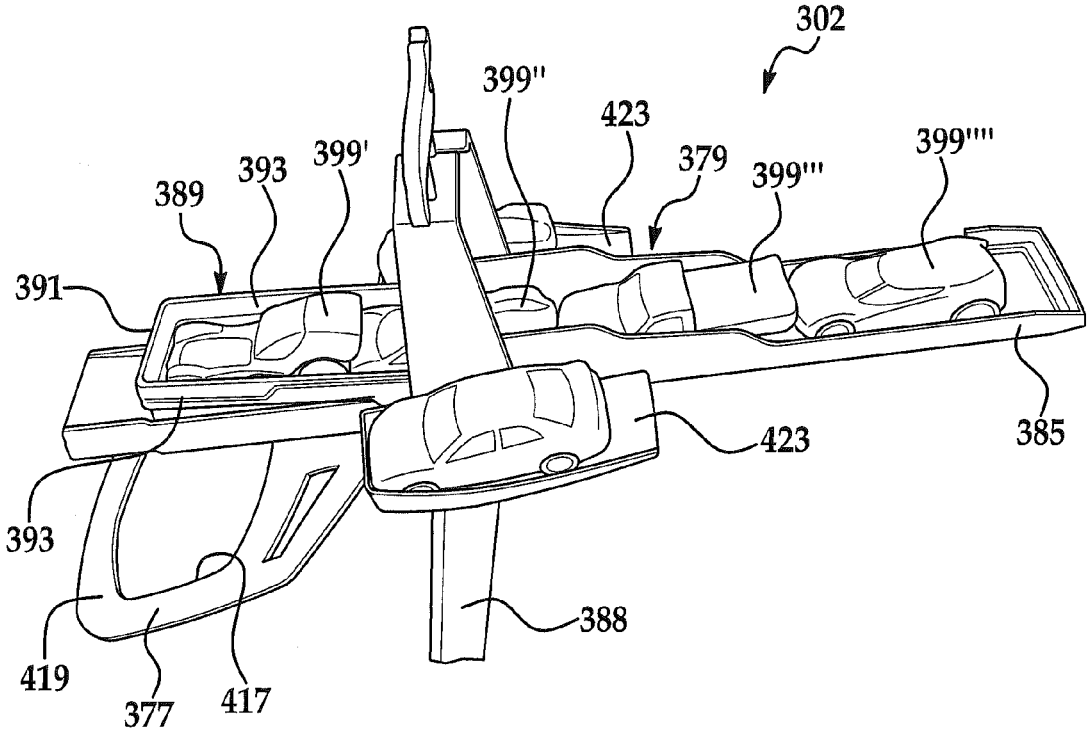
FIG. 10 is a top perspective view of the release mechanism of the FIG. 8.
Figure 11:
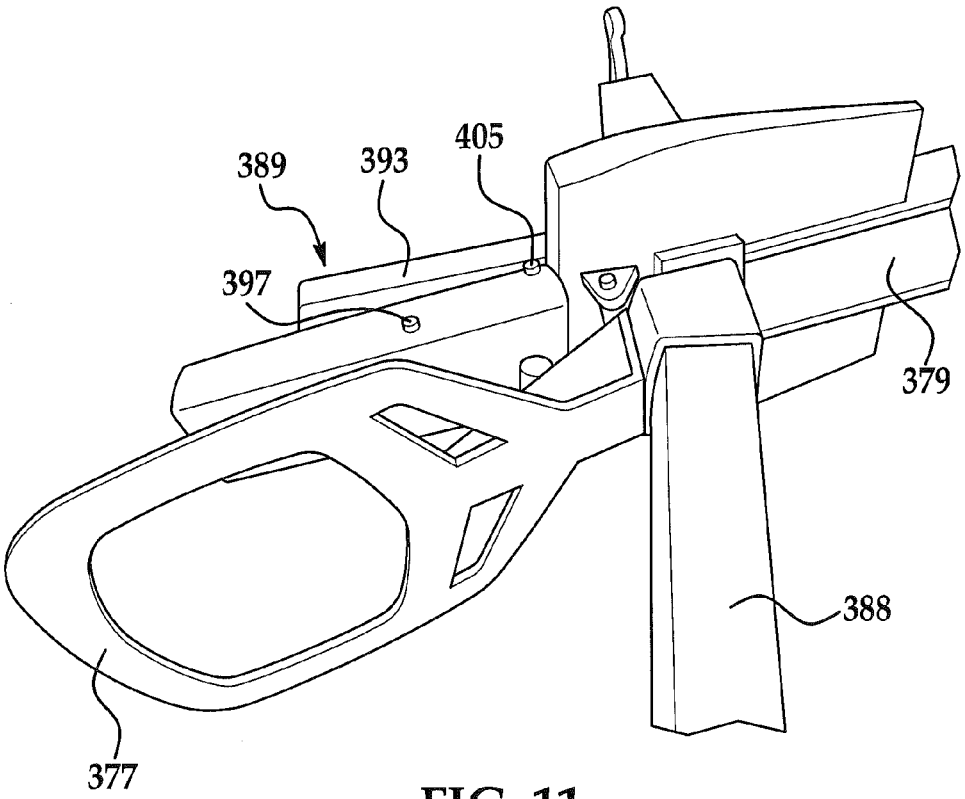
FIGS. 11 and 12 are perspective views of the release mechanism of the FIG. 8.
Figure 12:
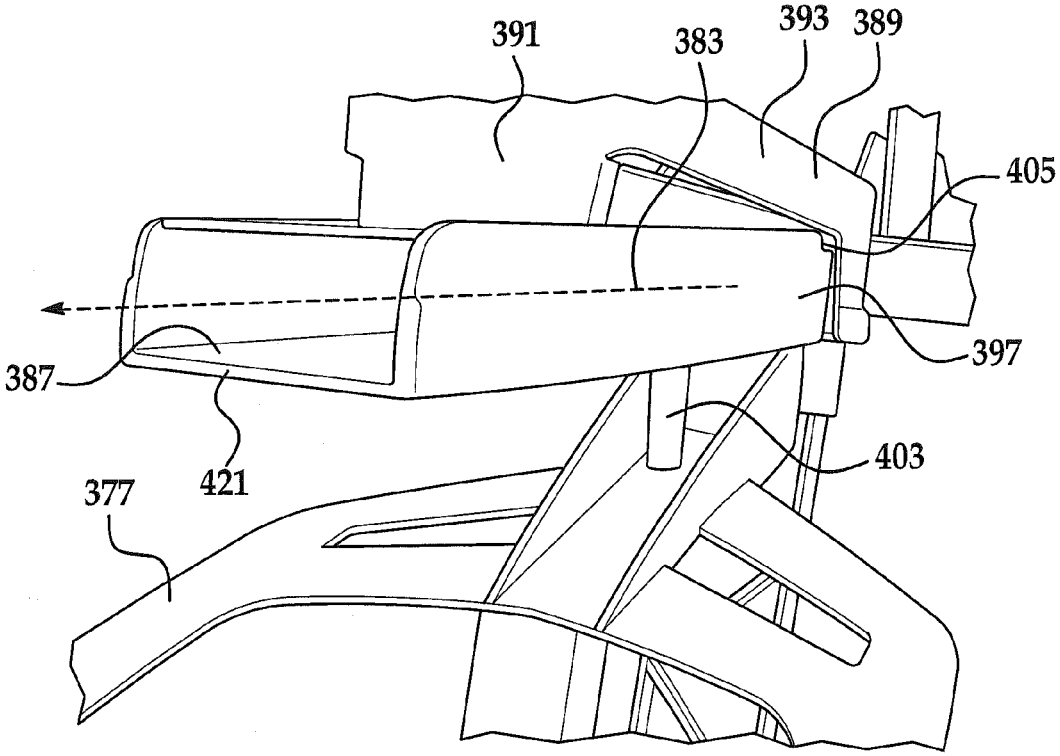

As illustrated in at least FIG. 10, base portion 379 is configured to have a pair of side portions 423 each of which is configured to receive an object or toy vehicle 399. In this embodiment, side portions 423 provide storage areas for vehicles to be subsequently loaded into the inlet end 385 of the base portion 379. In addition, the base portion may also have sidewalls proximate to the path of travel in order to guide the objects from the inlet end towards the outlet end. As illustrated in FIG. 10, a series of toy vehicles or objects 399', 399", 399'" and 399"" are each provided in sequence such that the first vehicle 399' will be released when the target is moved from the first position to the second position and adds the target moves back to the first position from the second position the second vehicle 399" will move onto the platform while the other two vehicles 399'" and 399"" will move forward leaving a space at the inlet and for another toy vehicle to be placed therein. For example, one of the toy vehicles may be selected from side portions 423 to be placed in the inlet end of the base portion. Although only four toy vehicles or objects are illustrated in the FIG. it is, of course, understood that numerous configurations (e.g., more or less than four) are contemplated to be within the scope of exemplary embodiments of the present invention.

In accordance with one embodiment the loading, indexing and subsequent release of each of the toy vehicles or objects is accomplished through gravity forces when movement of the target causes the release mechanism to allow at least one toy vehicle to roll out from the outlet end of the base portion. Thereafter and as in the previous embodiments, the released toy vehicle or object is then captured by the capturing section travels through the re-orientating section and onto the track path until it is powered by the booster to be launched from track section 384 towards the release mechanism 302. Still further, and in an alternative embodiment target 377 can also be manually actuated by a user by simply moving the target from the first position to second position to release a toy vehicle or object into the capturing section at any point during the travel of another vehicle around the tracks set thus, numerous variations are possible and release of objects into the capturing section need not be specifically limited to striking of the target by a vehicle launched from track section 384.

Figure 14A:
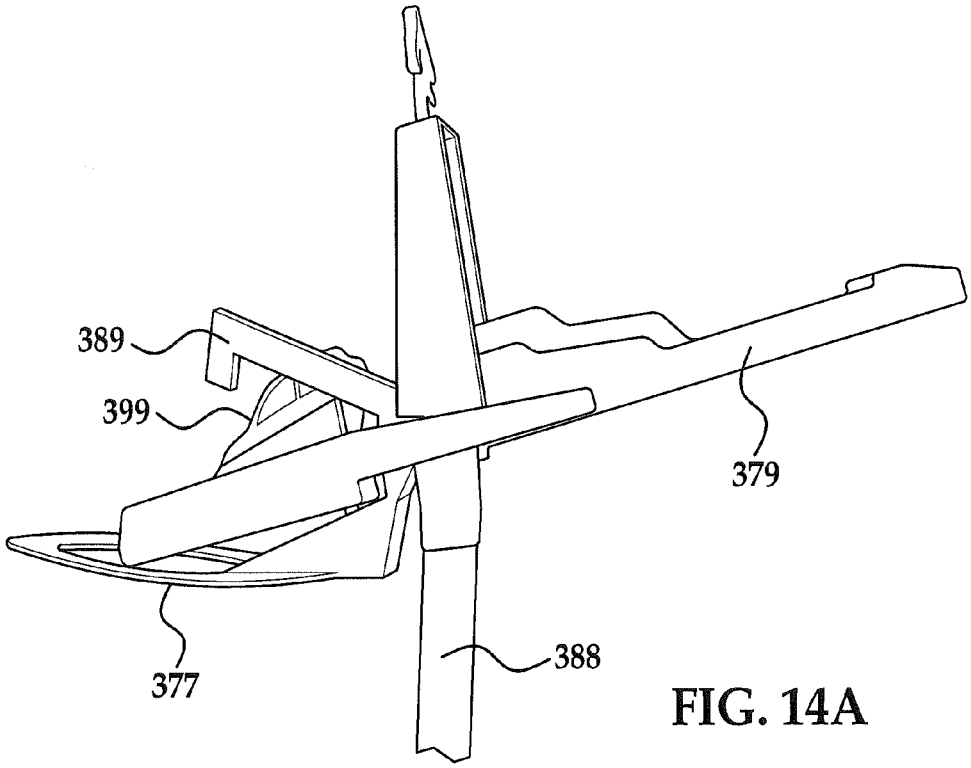
Figure 14B:
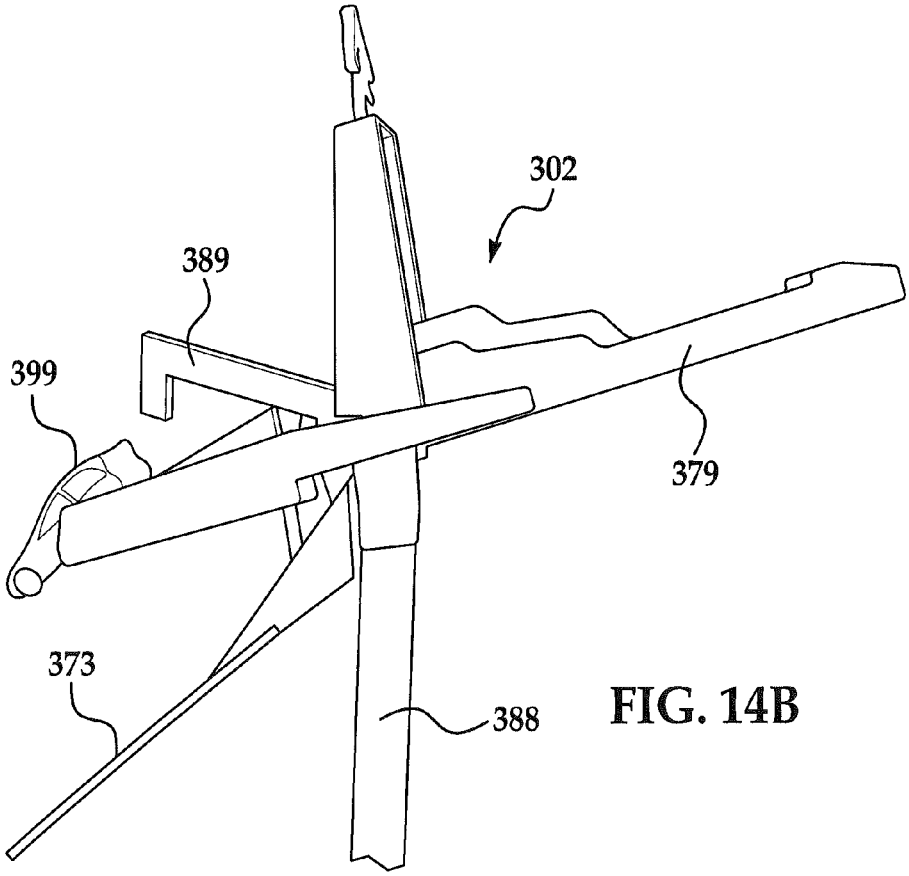
Figure 15A:
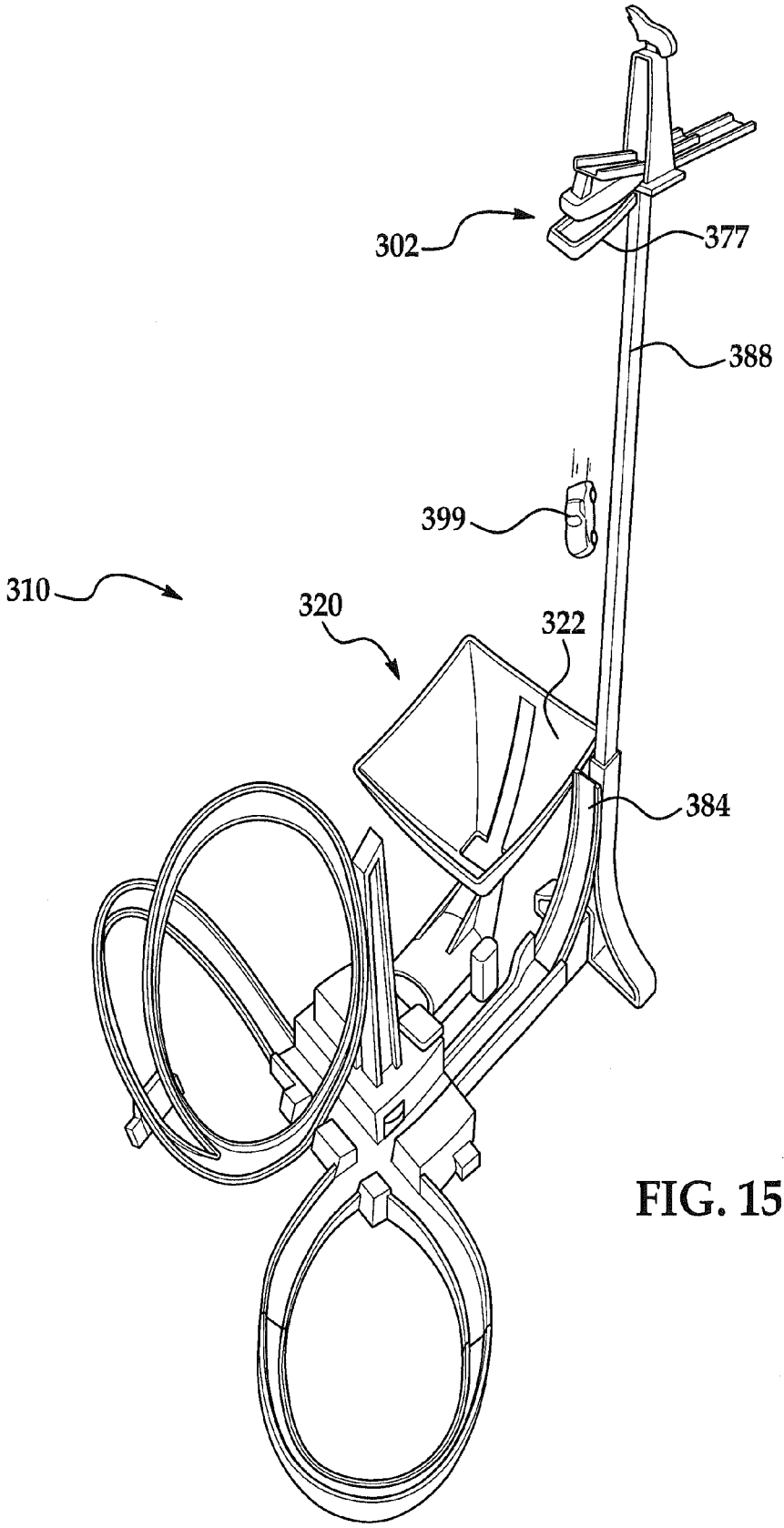
FIGS. 15A-15C illustrate an alternative exemplary embodiment of the present invention.
Figure 15B:
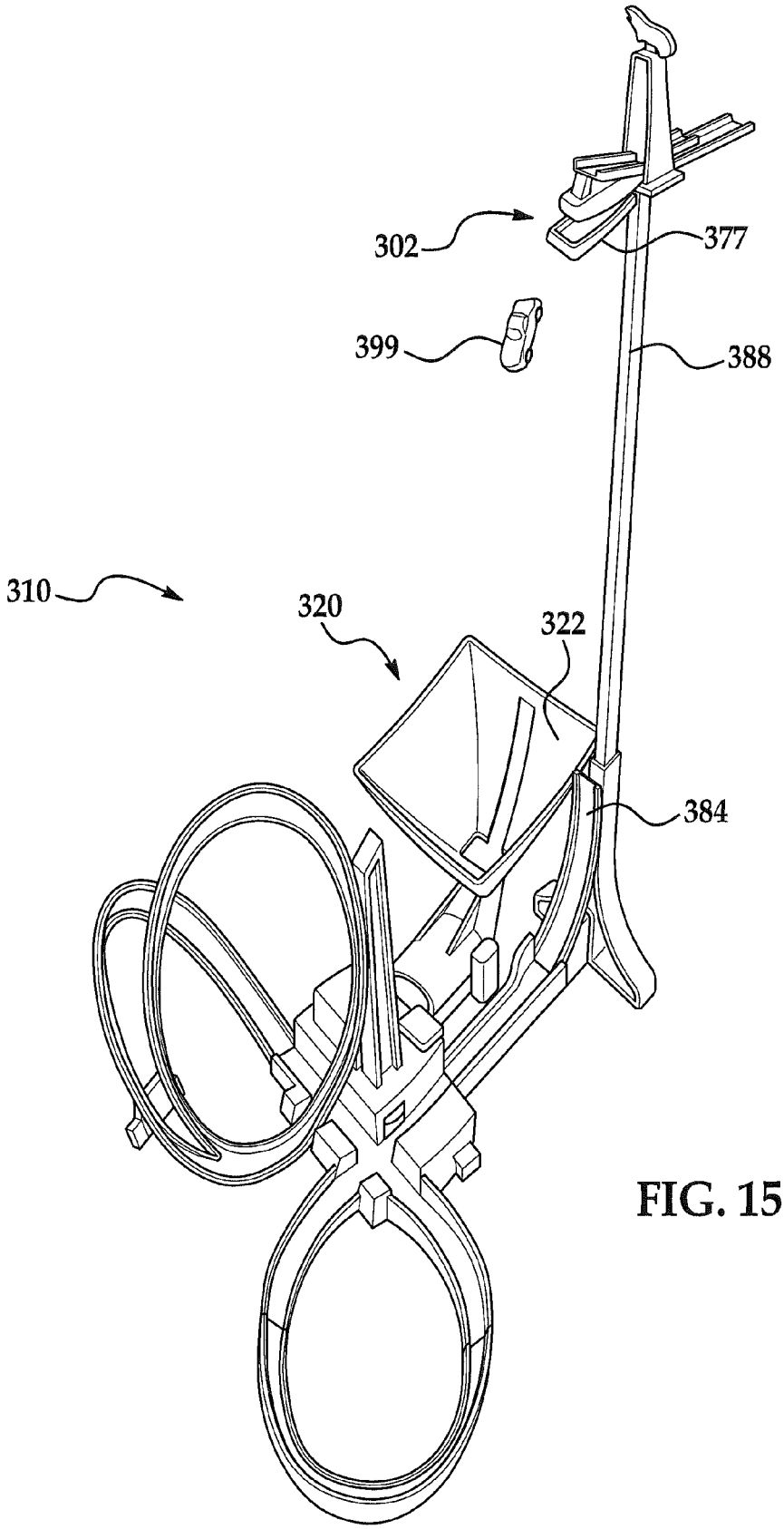
Figure 15C:
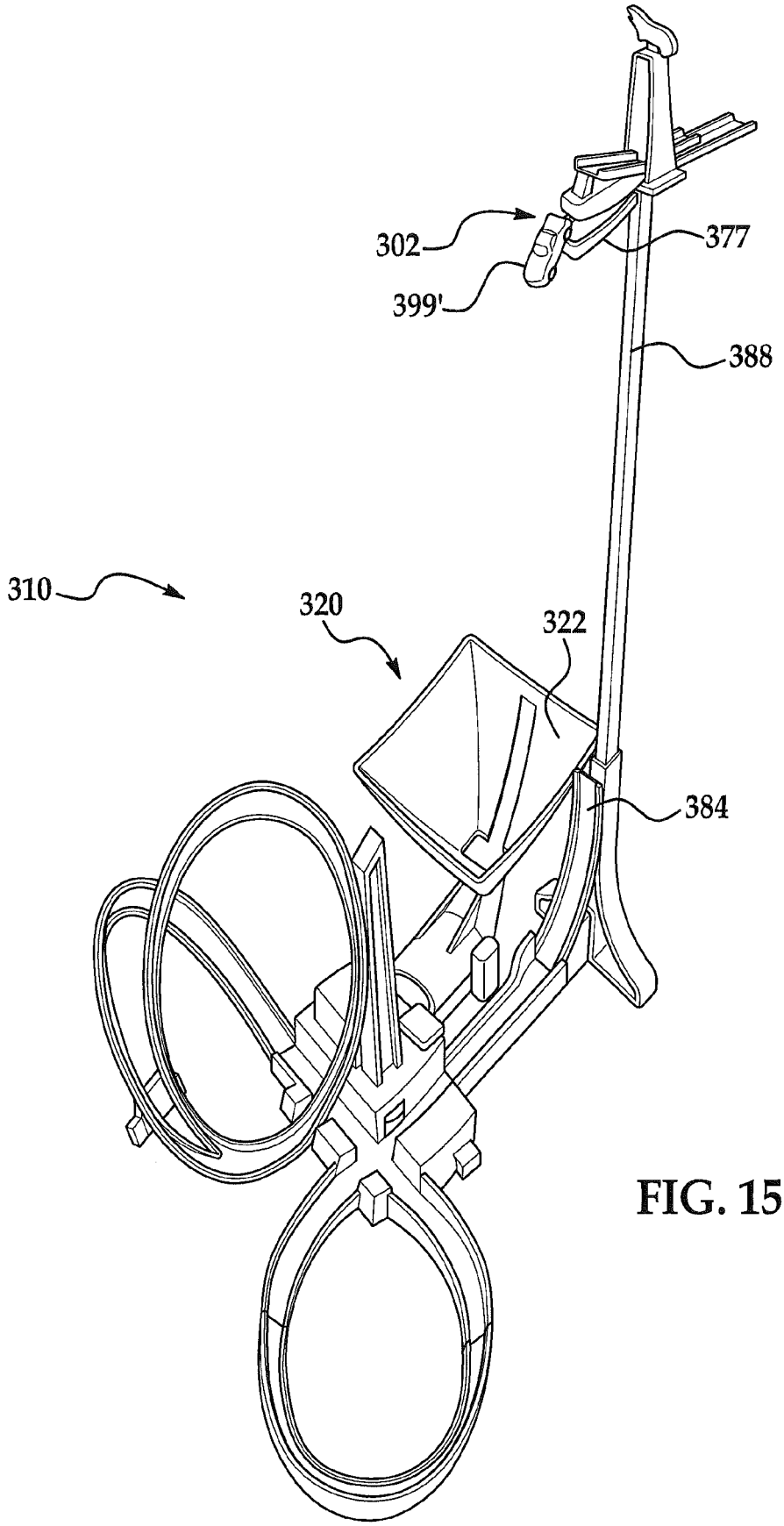

FIGS. 14A and 14B illustrate movement of the target 377 into the first position wherein a toy vehicle 399 is released from the release mechanism. FIG. 15A illustrates a toy vehicle 399 in mid flight traveling towards the release mechanism while FIG. 15B illustrates the toy vehicle hitting the release mechanism and being deflected back towards the capturing section and FIG. 15C illustrates another toy vehicle 399' being released from the release mechanism and dropping towards the capturing section 320. In this embodiment the target 377 does not have an opening 417 as illustrated in FIG. 10.

Referring back now to at least FIG. 12 portion 391 of gate 389 has an extended tab portion that extends downwardly from portion 391 this extended tab portion prevents a toy vehicle or object from being launched or released from the platform until the gate has been moved upward a sufficient amount still further, and as the toy vehicle travels under the gate this tab portion will ride along the upper surface of the toy vehicle until the same has exited from the platform and travel towards the outlet end of the base portion. Alternatively, the gate 389 can be configured without the extended tab portion.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A stunt arrangement for a toy vehicle, comprising:

a launching section configured to launch a propelled toy vehicle into flight;

a capturing section configured to receive the toy vehicle from the flight;

a deflection section disposed between the launching section and the capturing section and configured to be impacted by the toy vehicle in flight and to redirect the vehicle toward the capturing section, wherein the deflection section includes a target, the target being pivotally secured to a release mechanism for movement from a first position to a second position, wherein movement of the target from the first position to the second position causes the release mechanism to drop another toy vehicle towards the capturing section; and a reorienting section coupled to an outlet of the capturing section, the reorienting section being rotatably driven about the desired direction of travel and is configured to upright the toy vehicle or the another toy vehicle if either vehicle exits the capturing section partly or completely inverted.

2. The stunt arrangement as in claim 1, wherein the release mechanism further comprises a gate that is moved from a blocking position to an unblocking position when the target is moved from the first position to the second position.

3. The stunt arrangement as in claim 2, wherein the release mechanism further comprises a moveable platform configured for movement between a release position and a load position.

4. The stunt arrangement as in claim 3, wherein the target further comprises a rod configured to move the moveable platform from the load position to the release position and wherein the platform moves the gate from the blocking position to the unblocking position when the platform moves to the release position.

5. The stunt arrangement as in claim 4, wherein the platform further comprises a pair of pin members for engaging a pair of arm members of the gate to move the gate to the unblocking position when the platform moves to the release position.

6. The stunt arrangement as in claim 5, wherein the release mechanism further comprises a base portion and the target, the gate and the platform are each pivotally mounted to the base portion.

7. The stunt arrangement as in claim 6, wherein the target is pivotally mounted to the base portion at a first pivot point and the gate is pivotally mounted to the base portion at the first pivot point and the platform is pivotally mounted to the base portion at a second pivot point, the second pivot point being in a different location than the first pivot point.

8. The stunt arrangement as in claim 7, wherein the base portion defines a path of travel through the release mechanism, wherein the path of travel has an inlet end and an outlet end and the inlet end and the outlet end are configured to guide the toy vehicle from the release mechanism.

9. The stunt arrangement as in claim 8, wherein a portion of the gate is located in the path of travel when the gate is in the blocking position such that the toy vehicle will not advance to the outlet end unless the gate and its associated portion are moved to the unblocking position.

10. The stunt arrangement as in claim 1, wherein the release mechanism further comprises a gate that is moved from a blocking position to an unblocking position when the target is moved from the first position to the second position and wherein the release mechanism further comprises a moveable platform configured for movement between a release position and a load position and when the moveable platform is in the release position a forward end of the platform is moved downward while a rearward end of the moveable platform is moved upward and when the platform is in the loading position the forward end of the moveable platform is moved upward and the rearward end is moved downward.

11. The stunt arrangement as in claim 10, wherein the target further comprises a rod configured to move the moveable platform from the load position to the release position and wherein the platform moves the gate from the blocking position to the unblocking position when the platform moves to the release position and wherein the target further comprises an opening such that a launched toy vehicle may pass through the target and contact a base portion of the release mechanism.

12. The stunt arrangement as in claim 11, wherein the platform further comprises a pair of pin members for engaging a pair of arm members of the gate to move the gate to the unblocking position when the platform moves to the release position.

13. The stunt arrangement as in claim 12, wherein the target, the gate and the platform are each pivotally mounted to the base portion and wherein the target is pivotally mounted to the base portion at a first pivot point and the gate is pivotally mounted to the base portion at the first pivot point and the platform is pivotally mounted to the base portion at a second pivot point, the second pivot point being in a different location than the first pivot point.

14. The stunt arrangement as in claim 13, wherein the pair of pins are received in complementary slots in wall portions of the base portion as the rearward end of the moveable platform is moved downward.

15. A toy track set, comprising:

a path for a toy vehicle to travel along, a first portion of the path being defined by a track connecting a launching portion with a capturing portion and a second portion of the path being defined by an air gap located between the launching portion and the capturing portion;

a release mechanism positioned in the air gap, the release mechanism having a target, the target being pivotally secured to a release mechanism for movement from a first position to a second position, wherein movement of the target from the first position to the second position causes the release mechanism to drop another toy vehicle towards the capturing portion;

wherein the launching portion is configured to launch the toy vehicle into the air gap;

wherein the capturing portion is configured to capture the toy vehicle or the another toy vehicle from the air gap; and wherein the capturing portion further comprises a rotating tube that receives the toy vehicle or the another toy vehicle therein and directs the toy vehicle to the first portion of the path.

16. The toy track set as in claim 15, wherein the release mechanism is located on top of a stand such that the target is located in a position to be hit the toy vehicle launched into the air gap by the launching portion.

17. The toy track set as in claim 16, wherein the rotating tube is rotated at a constant speed by a motor.

18. The toy track set as in claim 15, wherein the release mechanism further comprises a gate that is moved from a blocking position to an unblocking position when the target is moved from the first position to the second position and wherein the release mechanism further comprises a moveable platform configured for movement between a release position and a load position and when the moveable platform is in the release position a forward end of the platform is moved downward while a rearward end of the moveable platform is moved upward and when the platform is in the loading position the forward end of the moveable platform is moved upward and the rearward end is moved downward and wherein the target further comprises a rod configured to move the moveable platform from the load position to the release position and wherein the platform moves the gate from the blocking position to the unblocking position when the platform moves to the release position.

19. A method of moving a plurality of toy vehicles along a toy vehicle track path, comprising:

storing at least one toy vehicle in a release mechanism;

moving at least one other toy vehicle along a path, a first portion of the path being defined by a track connecting a launching portion with a capturing portion and a second portion of the path being defined by an air gap located between the launching portion and the capturing portion, wherein the release mechanism is positioned in the air gap;

releasing the at least one toy vehicle from the release mechanism when a target pivotally secured to a release mechanism is moved from a first position to a second position by the at least one other toy vehicle traveling in the air gap;

wherein movement of the target from the first position to the second position causes the release mechanism to drop the at least one toy vehicle towards the capturing portion;

wherein the launching portion is configured to launch the at least one other toy vehicle into the air gap; and wherein the capturing portion is configured to capture the at least one toy vehicle or the at least one other toy vehicle from the air gap.

20. The method as in claim 19, wherein the capturing portion further comprises a rotating tube that receives the at least one toy vehicle or the at least one other toy vehicle therein and directs the at least one toy vehicle or the at least one other toy vehicle to the first portion of the path.

* * * * *